US010384696B2

(12) United States Patent
Schoedl et al.

(10) Patent No.: US 10,384,696 B2
(45) Date of Patent: Aug. 20, 2019

(54) RAILROAD CAR COUPLING SYSTEM

(71) Applicants: Erich A. Schoedl, Sugar Grove, IL (US); Kenneth A. James, West Chicago, IL (US); Andy R. Kries, Elgin, IL (US)

(72) Inventors: Erich A. Schoedl, Sugar Grove, IL (US); Kenneth A. James, West Chicago, IL (US); Andy R. Kries, Elgin, IL (US)

(73) Assignee: MINER ENTERPRISES, INC., Geneva, IL (US)

( * ) Notice: Subject to any disclaimer, the term of this patent is extended or adjusted under 35 U.S.C. 154(b) by 227 days.

(21) Appl. No.: 15/429,911

(22) Filed: Feb. 10, 2017

(65) Prior Publication Data

US 2017/0166225 A1 Jun. 15, 2017

Related U.S. Application Data

(63) Continuation-in-part of application No. 14/540,209, filed on Nov. 13, 2014, now Pat. No. 9,598,092.

(51) Int. Cl.
*B61G 9/04* (2006.01)
*B61G 9/24* (2006.01)
(Continued)

(52) U.S. Cl.
CPC ..... *B61G 9/04* (2013.01); *B61G 7/10* (2013.01); *B61G 9/06* (2013.01); *B61G 9/24* (2013.01); *B61G 11/18* (2013.01); *B61G 3/04* (2013.01)

(58) Field of Classification Search
CPC ... B61G 1/00; B61G 7/00; B61G 7/08; B61G 7/10; B61G 7/12; B61G 7/14; B61G 9/00;
(Continued)

(56) References Cited

U.S. PATENT DOCUMENTS 1,192,497 A 7/1916 Chiles
1,562,094 A 11/1925 Kadek et al.
(Continued)

*Primary Examiner* — Robert J McCarry, Jr.
(74) *Attorney, Agent, or Firm* — Law Office of John W. Harbst

(57) ABSTRACT

A railroad car coupling system including a draft sill with front and rear stops, a coupler along with an energy management assembly for receiving and dissipating external forces experienced by the coupler. A yoke also forms part of the coupling system and is operably coupled to the coupler. The yoke includes top and bottom walls which each include two forward facing stops. A follower is mounted substantially between the top and bottom walls of the yoke for receiving forces experienced by the coupler. The follower is configured with two laterally spaced vertical extensions disposed toward opposed upper corners of the follower and two laterally spaced vertical extensions disposed toward opposed lower corners of the follower. Forward facing surfaces on the follower extensions arc arranged in generally coplanar relationship relative to each other. Rearward facing surfaces on the follower extensions are arranged in generally coplanar relationship with each other and operably engage with the forward facing stops on the yoke to enhance the distribution of forces when the follower engages the front stops on the center sill when the coupling system is in a full draft condition.

28 Claims, 12 Drawing Sheets

(51) Int. Cl.

| | |
|---|---|
| ***B61G 11/18*** | (2006.01) |
| ***B61G 7/10*** | (2006.01) |
| ***B61G 9/06*** | (2006.01) |
| *B61G 3/04* | (2006.01) |

(58) Field of Classification Search
CPC ... B61G 9/02; B61G 9/04; B61G 9/06; B61G 9/08; B61G 9/12; B61G 9/14; B61G 9/16; B61G 11/00; B61G 11/02; B61G 11/08; B61G 11/10; B61G 11/14
See application file for complete search history.

(56) References Cited

U.S. PATENT DOCUMENTS

| | | | | |
|---|---|---|---|---|
| 5,176,268 | A | 1/1993 | Manley | |
| 5,305,899 | A | 4/1994 | Kaufhold | |
| 6,681,943 | B2 | 1/2004 | Barker et al. | |
| 8,136,683 | B2 | 3/2012 | Sprainis et al. | |
| 9,598,092 | B2 * | 3/2017 | James | B61G 7/10 |
| 2005/0011852 | A1 | 1/2005 | Fetterolf et al. | |

* cited by examiner

RAILROAD CAR COUPLING SYSTEM

RELATED APPLICATION

This patent application is a Continuation-In-Part patent application of copending and coassigned patent application Ser. No. 14/540,209, filed, Nov. 13, 2014; the entirety of which is incorporated herein by reference.

FIELD OF THE INVENTION DISCLOSURE

The present invention disclosure generally relates to railroad cars and, more specifically, to a railroad car coupling system for releasably connecting adjacent railcar ends to each other.

BACKGROUND

During the process of assembling or "making-up" a train consist, railcars are run into and collide with each other to couple them together. Since time is money, the speed at which the railcars are coupled has significantly increased. Moreover, and because of their increased capacity, railcars are heavier than before. These two factors and others have resulted in increased damages to the railcars when they collide and, frequently, to the lading carried within such railcars.

As railroad car designer/builders have reduced the weight of their designs, they have also identified a need to protect the integrity of the railcar due to excessive longitudinal loads being placed thereon, especially as the railcars are coupled to each other. Whereas, such longitudinal loads frequently exceed the design loads set by the AAR. Providing a coupling system at opposed ends of each railcar has long been known in the art. Such a system typically includes a draft assembly comprised of a coupler for releasably attaching two railcars to each other and a an energy management or cushioning assembly arranged in operable combination with each coupler for receiving and dissipating external forces experienced by the coupler during make-up of the train consist and during in-service operation of the railcar.

In-service train action events and impacts occurring during the "make-up" of a train consist subject the draft assembly at opposed ends of the railcars to buff impacts, while in-service train action events subject the draft assembly to draft impacts. The impacts associated with these events are transmitted from the couplers to the respective energy management or cushioning assembly and, ultimately, to the railcar body. That is, as the couplers are pushed or pulled, be it during in-service operations and/or during the "make-up" of a train consist, such movements, although muted to some degree by the cushioning assembly, are translated to the railcar body.

Typically, draft assemblies further include a yoke that is operably coupled to the coupler as through a pin or key, a follower, and the cushioning assembly. Generally, the follower is positioned against or arranged closely adjacent to the butt or rear end of a shank portion on the coupler in the draft pocket and within confines defined by the yoke. The cushioning assembly is positioned between the follower and rear stops on the draft sill.

In buff events, the rear or butt end of the coupler moves axially inward against the follower and toward rear stops on the draft sill. As the coupler and follower move rearward, a portion of the shock or impact event is absorbed and dissipated by the cushioning assembly.

In draft events, slack between adjacent railcars is taken up beginning at the end of the train and ending at the other end of the train. As a result of the slack being progressively taken up, the speed difference between the railcars increases as the slack inherent with each coupling system at each end of the railcar in the train consist is taken up, with the resultant increase in buff and draft impacts on the coupling system. For example, when a locomotive on a train consist of railcars initially begins to move from a stopped or at rest position, there may be 100 inches of slack between the 50 pairs of coupling systems. This slack is taken up progressively by each pair of joined coupling systems in the train consist. After the slack in the coupling system joining the last railcar to the train consist is taken up, the next to the last railcar may be moving at 4 miles per hour. Given the above, it will be appreciated, the slack in the coupling system of those railcars closest to the locomotive is taken up very rapidly and those two railcars closest to the locomotive are subjected to a very large impact event being placed thereon. Such large impact events are capable of damaging the lading in the railcars.

Moreover, most of today's railcars use and embody air brakes. Such air brakes require an air hose to extend between railcars. While bridging the distance between adjacent railcars, the length of such air hoses is limited unless two or more air hoses are coupled to each other whereby adding to the overall cost. Of course, if the distance between the railcars exceeds the length of the air hose, the air hoses will separate from each other thereby affecting control over the braking function. Accordingly, there is a need to limit coupler travel in draft whereby limiting the distance between railcars during in-service operation of the train consist.

Thus, there is a continuing need and desire for a railcar coupling system which is capable of limiting the travel of the system during operation of the railcar in both buff and draft directions.

SUMMARY

According to one aspect of this invention disclosure, there is provided a railroad car coupling system including an axially elongated draft sill defining a draft pocket between front stops and rear stops on the draft sill. To allow adjacent railcars to be releasably coupled to each other, the railcar coupling system also includes a coupler having a coupler head disposed toward a first end and a butt end. As is typical, the head portion of the coupler axially extends beyond the draft sill. An energy management or cushioning assembly is provided in operable combination with the coupler for receiving and dissipating external forces experienced by the coupler. The cushioning assembly is positioned in the draft pocket between the front and rear stops. In one embodiment, the cushioning assembly includes a draft gear assembly with a walled housing. Alternatively, and without detracting or departing from this invention disclosure, the energy management system or cushioning assembly can include multiple cushioning assemblies arranged in generally axially aligned relation relative to each other.

A yoke, disposed within the pocket defined by the draft sill, also forms part of the coupling system. The yoke includes a back wall, a top wall joined to and axially extending from the back wall toward an open forward end of the yoke, and a bottom wall joined to and axially extending from the back wall toward the open forward end of the yoke. The top wall and bottom wall of the yoke are vertically separated from each other and embrace the cushioning assembly for sliding movements therebetween. The back wall of the yoke is disposed to contact the rear end of the cushioning assembly. The top and bottom walls of the yoke are operably coupled to the coupler toward a forward open end of the yoke.

One of the salient features of this invention disclosure involves providing each of the top and bottom walls of the yoke with two stops which extend in opposed lateral directions from each other. Four forward facing surfaces on the stops are arranged in generally coplanar relationship with each other. Suffice it to say, the coupling system has a neutral position, a full buff position disposed a first predetermined distance from the neutral position, and a full draft position disposed a second predetermined distance from the neutral position, with the full buff and full draft positions for the energy absorption coupling system being disposed in opposite directions from the neutral position. In those embodiments wherein the cushioning assembly includes a draft gear assembly with a walled housing, the yoke is slidably movable relative to the walled housing of the draft gear assembly or draft gear assemblies.

A follower is mounted substantially between the top and bottom walls of the yoke for receiving forces experienced by the coupler member. The follower is positioned transversely relative to the longitudinal axis of the yoke and has a generally rectangular configuration including a front face and a rear face. The follower is arranged urged toward the open end of the yoke by the cushioning assembly such that the front face of the follower is urged into contact with the butt end of the coupler. A top side of the follower is configured with two laterally spaced vertical extensions disposed toward opposed upper corners of the follower. A bottom side of the follower is configured with two laterally spaced vertical extensions disposed toward opposed lower corners of the follower. Forward facing surfaces on the extensions are arranged in generally coplanar relationship relative to each other and enhance the surface contact area with the front pair of stops on the draft sill while furthermore enhancing the distribution of forces when the follower engages the front stops on the center sill when the coupling system is in a full draft condition. Rearward facing surfaces on the extensions are arranged in generally coplanar relationship to each other and operably engage with the forward facing stop surfaces on the yoke so as to furthermore enhance the distribution of forces when the follower engages the front stops on the center sill when the coupling system is in a full draft condition.

Preferably, the draft travel of the coupling system is independently controlled relative to buff travel and is regulated as a function of the location of the four forward facing stops on said yoke. In one form, the railroad car coupling system will have a total combined travel in both draft and buff directions of about 6.5 inches. With other cushioning assembly designs, the combined travel in both draft and buff directions can be greater or less than 6.5 inches without detracting or departing from the spirit and scope of this invention disclosure.

The stops on the yoke preferably prevent potential separation of the coupler from the center sill structure. In one form, the stops on the yoke are formed integral with the top and bottom walls of the yoke. In a preferred embodiment, the two stops on the top wall of the yoke are arranged in generally coplanar relation with the top wall of the yoke while the other two stops on the bottom wall of the yoke are arranged in generally coplanar relation with the bottom wall of the yoke.

According to another feature of this invention disclosure, there is provided a railroad car coupling system extending longitudinally into a car center sill structure for releasably connecting adjacent railcar ends. The center sill structure defines a cavity, a longitudinal axis, along with longitudinally spaced pairs of front and rear stops. According to this aspect of the invention disclosure, the coupling system includes a yoke movably retained within the cavity defined by the center sill structure. The yoke has a longitudinal axis arranged in general alignment with the center sill longitudinal axis and includes top and bottom walls which extend longitudinally and generally parallel to each other. The top and bottom and bottom walls of the yoke are connected to a rear wall so as to define a yoke pocket with an open end. The top wall of the yoke has two forward facing stops which are arranged in generally coplanar relationship relative to each other and extend in opposed lateral directions relative to the longitudinal axis of the yoke. The bottom wall of the yoke has two forward facing stops which are arranged in generally coplanar relationship relative to each other and extend in opposed lateral directions relative to the longitudinal axis of the yoke. The forward facing stops on the top and bottom walls of the yoke are arranged in generally coplanar relationship relative to each other. Preferably, the stops on the yoke prevent potential separation of the coupler from the center sill structure.

The coupling system also includes a coupler having a coupler head disposed toward a first end and outward from an end of the center sill and a butt end extending from the coupler head and longitudinally into the yoke pocket. The coupler is operably coupled to the yoke. Moreover, an energy management or cushioning assembly is arranged in the yoke pocket for receiving and dissipating external forces experienced by said coupler member, with such forces being transferred from the coupler head to the butt end of the coupler. In one embodiment, the cushioning assembly includes a draft gear assembly having a walled housing. In those embodiments where the cushioning assembly includes a walled housing, the yoke of the coupling system is slidably movable relative to the walled housing of the cushioning assembly.

The coupling system also includes a follower arranged substantially between the top and bottom walls of the yoke for receiving forces experienced by the coupler. The follower is positioned transversely relative to the longitudinal yoke axis and includes a front face and a rear face. The follower is arranged urged toward an open end of the yoke by the cushioning assembly such that the front face of the follower is urged into contact with the butt end of the coupler. The follower contacts the front pair of stops on the center sill when the coupling system is in a neutral or full draft condition. In one embodiment, the follower and yoke define cooperating instrumentalities for restricting a type of follower which can be mounted substantially between the top and bottom walls of the yoke.

The cooperating instrumentalities for restricting the type of follower which can be mounted substantially between the top and bottom walls of the yoke preferably includes preclusion gussets on one of the yoke and the follower and relief notches defined by the other of the yoke and the follower. In a preferred embodiment, the preclusion gussets of the cooperating instrumentalities for restricting the type of follower which can be mounted substantially between said top and bottom walls of said yoke are arranged on the yoke a further distance from the rear wall of the yoke than are the stops on the yoke.

In a preferred form, the draft travel of the coupling system is independently controlled relative to buff travel of the coupling system and is regulated as a function of the location of the four forward facing stops on the yoke. In one form, the railroad car coupling system will have a total combined travel in both draft and buff directions of about 6.5 inches. Depending upon the cushioning assembly design, however, the combined travel in both draft and buff directions can be greater or less than 6.5 inches without detracting or departing from the spirit and scope of this invention disclosure.

Preferably, two stops on the yoke are formed integral with each of the top and bottom walls of the yoke. In one form, the two stops on the top wall of the yoke are arranged in generally coplanar relation with the top wall of the yoke while the two stops on the bottom wall of the yoke are arranged in generally coplanar relation with the bottom wall of the yoke.

According to another aspect of this invention disclosure, there is provided a railroad car coupling system extending longitudinally into a car center sill structure for releasably connecting adjacent railcar ends. The center sill structure defines a cavity, a longitudinal axis, along with longitudinally spaced pairs of front stops and rear stops. According to this aspect of the invention disclosure, the coupling system includes a yoke retained within the cavity defined by the center sill structure. The yoke has a longitudinal axis arranged in general alignment with the center sill longitudinal axis and includes top and bottom walls which extend longitudinally and generally parallel to each other toward am open end of the yoke. The top and bottom walls of the yoke arc each connected to a rear wall so as to define a yoke pocket. The top wall of the yoke has two forward facing stops which are arranged in generally coplanar relationship relative to each other and extend in opposed lateral directions relative to the longitudinal axis of the yoke. The bottom wall of the yoke has two forward facing stops which are arranged in generally coplanar relationship relative to each other and extend in opposed lateral directions relative to the longitudinal axis of the yoke. The forward facing stops on the top and bottom walls of the yoke are all arranged in generally coplanar relationship relative to each other. Advantageously, and if the yoke should fail or otherwise break, the stops on the yoke guard against adjacent railcars from becoming inadvertently separated from each other. Preferably, the stops are formed integral with the top and bottom walls of the yoke.

The coupling system further includes a coupler having a coupler head disposed toward a first end and outward from an end of the center sill and a butt end extending from the coupler head and longitudinally into the yoke pocket. The coupler is operably coupled to the yoke. An energy management or cushioning assembly is arranged in the yoke pocket for receiving and dissipating external forces experienced by the coupler; with the forces being transferred from the coupler head to the butt end of the coupler.

In this alternative embodiment of the invention disclosure, the coupling system further includes a follower mounted substantially between the top and bottom walls of the yoke for receiving forces experienced by the coupler. The follower is positioned transversely relative to the longitudinal axis of the yoke and has a generally rectangular configuration including a front face and a rear face. The follower is arranged urged toward the open end of the yoke by the cushioning assembly such that the front face of the follower is urged into contact with the butt end of the coupler. A top side of the follower is configured with two laterally spaced vertical extensions disposed toward opposed upper corners of the follower. A bottom side of the follower is configured with two laterally spaced vertical extensions disposed toward opposed lower corners of the follower. Forward and rearward facing surfaces on the follower extensions are arranged in generally coplanar relationship relative to each other. The forward facing surfaces on the follower extensions are arranged in operable engagement with the front stops on the center sill when the coupling system is in either a neutral or full draft position or condition. The rearward facing surfaces on the follower extensions are arranged in operable engagement with the forward facing stops on the yoke so as to enhance the distribution of force when the forward facing surfaces on the extensions operably engage the front stops on the center sill when the coupling system is in a full draft condition. In this embodiment, the follower and the yoke define cooperating instrumentalities for restricting the follower which can be mounted substantially between the top and bottom walls of the yoke.

Preferably, the draft travel of the coupling system is independently controlled relative to buff travel of the coupling system and is regulated as a function of the location of the four forward facing stops on the yoke. In one form, the railroad car coupling system will have a total combined travel in both draft and buff directions of about 6.5 inches. As discussed above, with other cushioning assembly designs, the combined travel in both draft and buff directions can be greater or less than 6.5 inches without detracting or departing from the spirit and scope of this invention disclosure.

In a preferred embodiment, the cushioning assembly includes a draft gear assembly having a walled housing. In one form, the two stops on the top wall of the yoke are arranged in generally coplanar relation with the top wall of the yoke and the other two stops on the bottom wall of the yoke are arranged in generally coplanar relation with the bottom wall of the yoke. In those embodiments where the cushioning assembly includes a draft gear assembly with a walled housing, the yoke is slidably movable relative to the walled housing of the draft gear assembly.

Preferably, the cooperating instrumentalities for restricting the type of follower which can be mounted substantially between the top and bottom walls of the yoke includes preclusion gussets on one of the yoke and the follower and relief notches defined by the other of the yoke and follower. In a preferred embodiment, the preclusion gussets of the cooperating instrumentalities for restricting the type of follower which can be mounted substantially between the top and bottom walls of the yoke are arranged on the yoke a further distance from the rear wall of the yoke than are the stops on the yoke.

DETAILED DESCRIPTION

Figure 1:
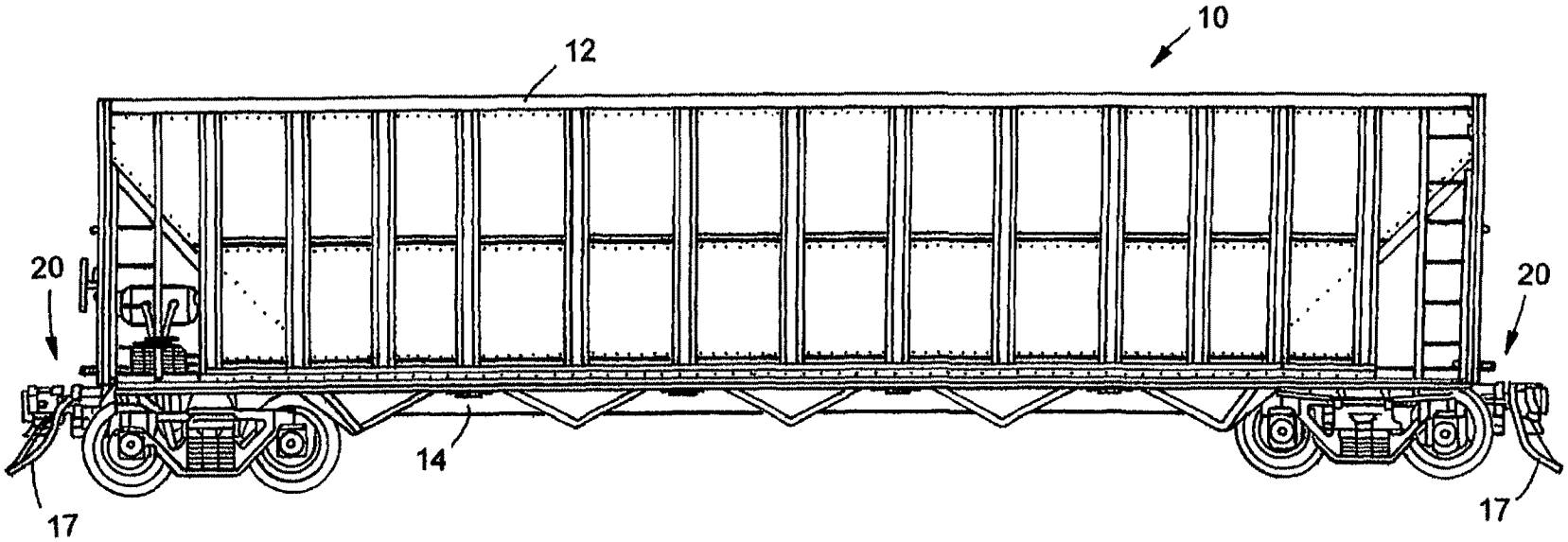
FIG. 1 is a side view of a railcar embodying principals and teachings of the present invention disclosure.

While this invention disclosure is susceptible of embodiment in multiple forms, there is shown in the drawings and will hereinafter be described preferred embodiments, with the understanding the present disclosure is to be considered as setting forth an exemplification of the disclosure which is not intended to limit the disclosure to the specific embodiments illustrated and described.

Referring now to the drawings, wherein like reference numerals indicate like parts throughout the several views, there is shown in FIG. 1 a railroad car, generally indicated by reference numeral 10. Although a railroad freight car is illustrated in the drawings for exemplary purposes, it will be appreciated the teachings and principals of this invention disclosure relate to a wide range of railcars including but not limited to railroad freight cars, tank cars, railroad hopper cars, and etc. Suffice it to say, railcar 10 has a railcar body 12, in whatever form, supported on a draft sill or center sill structure 14 defining a longitudinal axis 16 (FIG. 2) for and extending substantially the length of railcar 10. Railcar 10 includes a conventional brake system which is preferably operated by air. In this regard, and as known in the art, air hoses 17 (FIG. 1) extend from opposite ends of the car and operably connect with air hoses from an axially adjacent railcar after the cars are coupled in a train consist relative to each other.

As shown in FIG. 1, a coupling system, generally identified by reference numeral 20, and embodying teachings and principals of this invention disclosure is provided toward opposed ends of the railcar 10. In a preferred embodiment, and to reduce costs, the coupling system provided toward opposed ends of the railcar 10 are substantially identical and, thus, are both identified by reference numeral 20.

Returning to FIG. 2, the draft sill or center sill structure 14 defines a cavity 21. The center sill structure 14 can be cast or fabricated and has standard features. In the embodiment shown in FIG, 2, and toward each end thereof, the center sill structure 14 has stops including a laterally spaced pair of front stops 23 and laterally spaced pair of rear stops 23' connected to laterally spaced walls 24 and 26 of the center sill structure 14 (FIG. 3). The front and rear pairs of stops 23 and 23', respectively, are longitudinally spaced apart from each other. In a preferred embodiment, the front and rear pairs of stops 23 and 23', respectively, extend the full height of the draft sill or center sill structure 14.

In the embodiment shown in FIG. 3, the center sill structure 14 also has a top wall 28, although it will be appreciated the present invention disclosure is equally applicable to and can be used with a sill structures lacking such a top wall. Returning to FIG. 2, the stops 23, 23'on the center sill structure 14 combine to define a draft gear pocket 30 therebetween. The center sill structure 14 can have other standard features and is preferably made of standard materials in standard ways. The coupling system 20 of this invention disclosure may advantageously be used with either cast or fabricated draft sills. In one embodiment, the draft gear pocket, i.e., the longitudinal distance between the inboard faces of the front pair of stops 23 and the inboard faces of the rear pair of stops 23' measures 24.625 inches.

Figure 4:
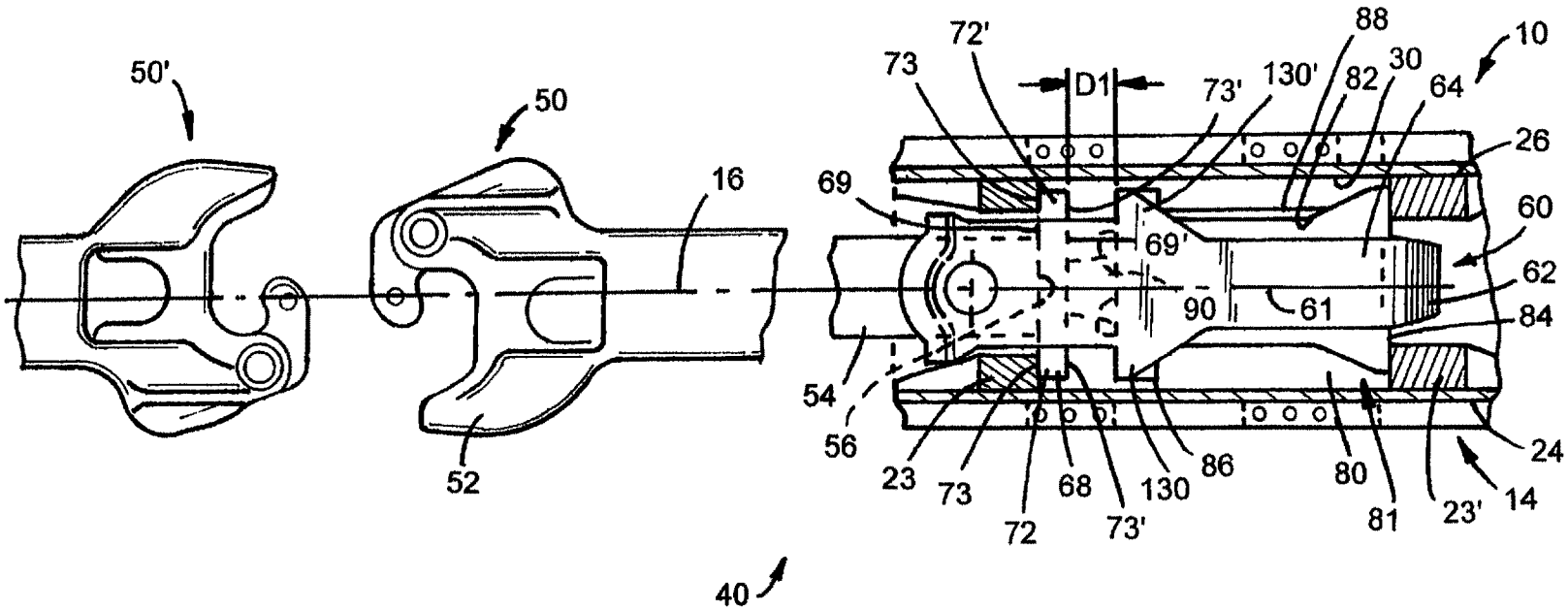
FIG. 4 is a sectional view taken along line 4-4 of FIG. 3 showing the first embodiment of the energy absorption/coupling system in a neutral position.

As shown in FIG. 4, each coupling system 20 has a draft system 40 primarily including a standard coupler 50 and an energy management or cushioning assembly 80 in longitudinally disposed and operable combination relative to each other. The standard coupler 50 of each draft system 40 includes a head portion 52 and butt or shank portion 54, preferably formed as a one-piece casting. As is typical, the coupler head portion 52 extends longitudinally outward from the center sill structure 14 to engage a similar coupler 50' extending from an end of a second and adjacent railcar to be releasably coupled or otherwise connected to car 10. In operation, the butt or shank portion 54 of the coupler 50 is guided for generally longitudinal movements by the center sill structure 14 of the railcar 10.

Preferably, each draft system 40 furthermore includes a yoke 60 which is retained within the cavity 21 (FIG. 2) of the center sill structure and has a longitudinal axis 61. When disposed within the cavity 21, the longitudinal axis 14 of car 10 and the longitudinal axis 61 of yoke 60 are preferably arranged in generally coaxial relationship with each other. In one form, the yoke 60 comprises an open-ended steel casting or it can be fabricated from separate steel components. In the embodiment illustrated by way of example in FIG. 4, yoke 60 is configured for use with a standard F coupler but it will be appreciated with slight redesign efforts, known to those skilled in the art, the teachings and principals of this invention disclosure equally apply to a yoke which is configured for use with a standard E coupler without detracting or departing from the novel spirit and broad scope of this invention disclosure.

Figure 2:
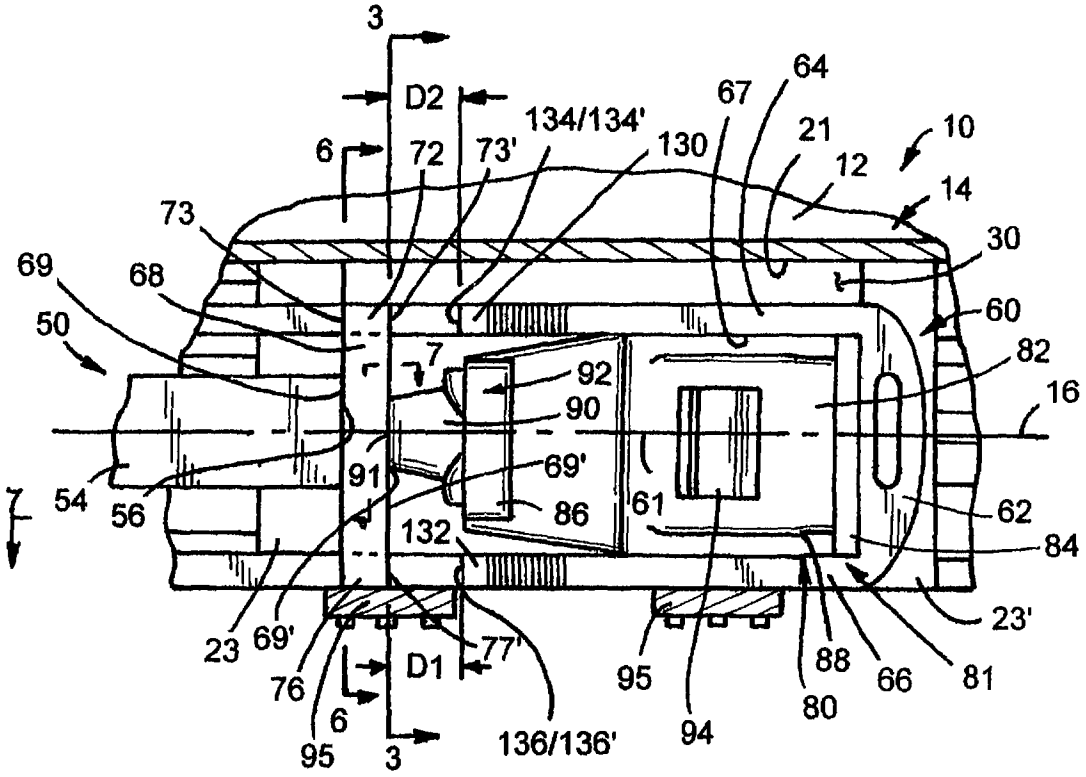
FIG. 2 is an enlarged fragmentary longitudinal sectional view of a portion of an energy absorption/coupling system embodying principals and teachings of this invention disclosure.
Figure 3:
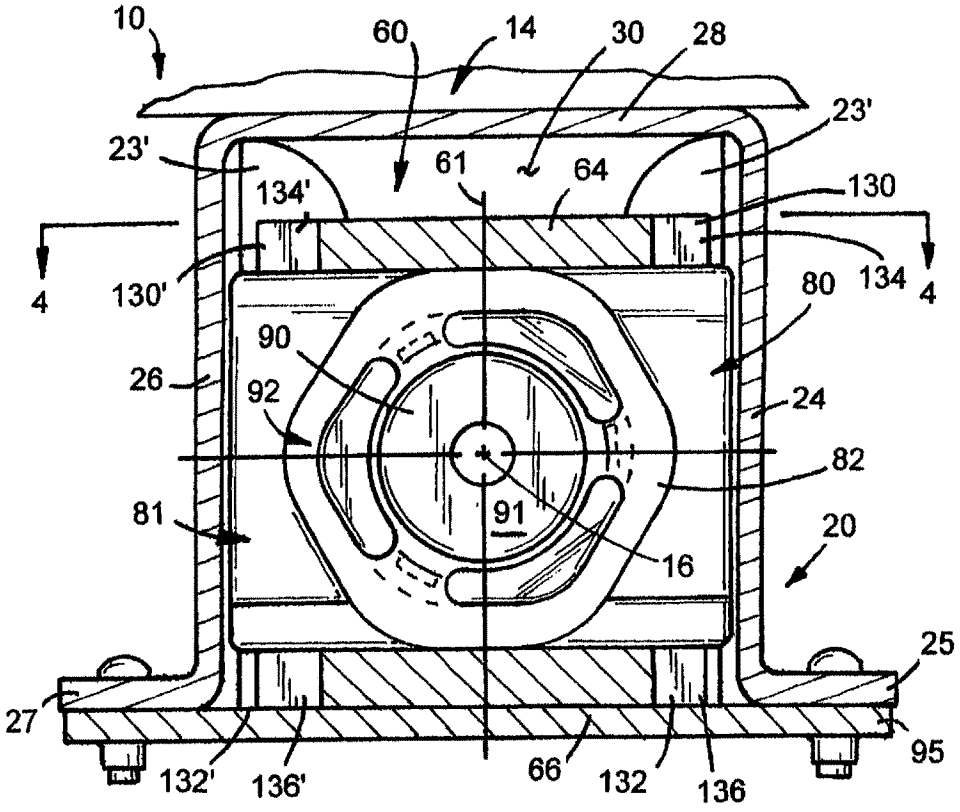
FIG. 3 is a sectional view taken along line 3-3 of FIG. 2.

As shown in FIG. 2, yoke 60 has a sideways inverted generally U-shaped configuration including back wall 62, an axially elongated top wall 64 joined to and axially extending longitudinally from the back wall 62 toward a forward end of the cushioning assembly 80 and an elongated bottom wall 66 joined to and axially extending longitudinally from the back wall 62 toward the forward end of the cushioning assembly 80. The walls 62, 64 and 66 of yoke combine with each other to define a linearly unobstructed yoke pocket or chamber 67 extending from the back wall 62 to the open end thereof. As known, the top wall 64 and bottom wall 66 of yoke 60 extend generally parallel and are separated from each other to readily accommodate the cushioning assembly 80 therein (FIG. 3). In the illustrated embodiment, the top and bottom walls 64 and 66, respectively, of yoke 60 embrace the cushioning assembly 80 therebetween and allow for endwise or longitudinal sliding movements of the cushioning assembly relative thereto. As shown in FIG. 2, the yoke 60 is configured such that the back wall 62 of the yoke 60 presses against and pushes the cushioning assembly 80 forward during a draft operation of the coupling system 20. Toward a forward open end thereof, and after other components of the draft system 40 are arranged in operable combination relative to each other, as discussed below, yoke 60 is operably coupled to the shank or butt portion 54 of coupler 50 as by a key or pin.

The cushioning assembly 80 of each energy absorption/coupling system 20 is installed in general alignment with the longitudinal axis 16 between the pairs of stops 23, 23' for receiving and dissipating external forces experienced by the coupler 50; with such forces being transferred from the coupler head portion 52 to the butt end 54 of the coupler 50 during make-up of a train consist and in-service operations of such a train consist. As will be appreciated by those skilled in the art, the energy management device or cushioning assembly 80 can take on any of a myriad of different designs and different operating characteristics without seriously departing or detracting from the true spirit and novel concept of this invention disclosure.

As an example, the cushioning assembly 80 can include a draft gear assembly generally designated by reference numeral 81 which can be accommodated in a conventionally sized draft gear pocket. The draft gear assembly 81 can be of the type manufactured and sold by Miner Enterprises, Inc. of Geneva, Ill. under Model No. TF-880 or Model No. Crown SE or any other equivalent and conventional draft gear assembly. Alternatively, and without detracting or departing from this invention disclosure, the energy management system or cushioning assembly can include multiple cushioning assemblies arranged in generally axially aligned relation relative to each other.

Suffice it to say, and in the embodiment illustrated by way of example, the draft gear assembly 81 includes: a hollow metallic housing 82 having a closed rear end 84 and an open forward end 86 and series of walls 88 extending between the ends 84 and 86, a spring biased linearly reciprocal wedge member 90 forming part of a friction clutch assembly 92, and a spring assembly 94 which, in the illustrated embodiment, is operably positioned within the draft gear assembly housing 82. In the embodiment shown by way of example, the top and bottom walls 64 and 66, respectively, of the yoke 60 embrace the housing 82 of draft gear assembly 81 therebetween. As shown in FIG. 2, a free end 91 of the wedge member 90 typically extends a predetermined distance D1 past the open end 86 of the housing 82 when the yoke 60 is in a neutral position. In the embodiment illustrated by way of example in FIGS. 2 and 4, the free end 91 of the wedge member 90 axially extends about 3.25 inches beyond the open end 86 of the draft gear housing 82 when the yoke 60 is in a neutral position. In the illustrated embodiment, the draft gear assembly 81 is designed to both consistently and repeatedly withstand impact events directly axially theretoward.

In the embodiment shown by way of example in FIGS. 2 and 4, each draft system 40 furthermore includes a coupler follower 68 disposed between an inner or free end 56 of the shank portion 54 of coupler 50 and the cushioning assembly 80. As is conventional, the follower 68 is positioned transversely relative to the longitudinal axis 61 of yoke 60 for receiving forces experienced by the coupler member 50. The follower 68 is movable in both forward and rearward longitudinal directions. The follower 68 is mounted substantially between the top wall 64 and bottom wall 66 of the associated yoke 60. The coupler follower 68 is configured with a major forward facing first surface 69 disposed to engage with the free end 56 of the shank portion 54 of coupler 50 and a major rearward facing generally flat second surface 69' disposed to engage with the forward end of the cushioning assembly 80.

In the embodiment illustrated by way of example in FIGS. 2 and 4, and when the cushioning assembly 80 includes a draft gear assembly, the coupler follower 68 is arranged in operable combination with the free end 91 of the wedge member 90 of draft gear assembly 81 and is urged toward an open end of the yoke 60 such that the front or forward facing surface 69 of the follower 68 is urged into contact with the free end 56 of the shank portion 54 of coupler 50 when the coupling system 20 is installed in the center sill or draft sill 14. In the embodiment of the follower illustrated by way of example in FIG. 5, the forward facing first surface 69 of the coupler follower 68 is shown as being generally flat or planar. It will be appreciated, however, the major forward facing surface 69 of follower can have a contoured/concave recess for accommodating the free end 56 of the shank portion 54 of coupler 50 without detracting or departing from either the spirit or broad scope of this invention disclosure.

Figure 5:
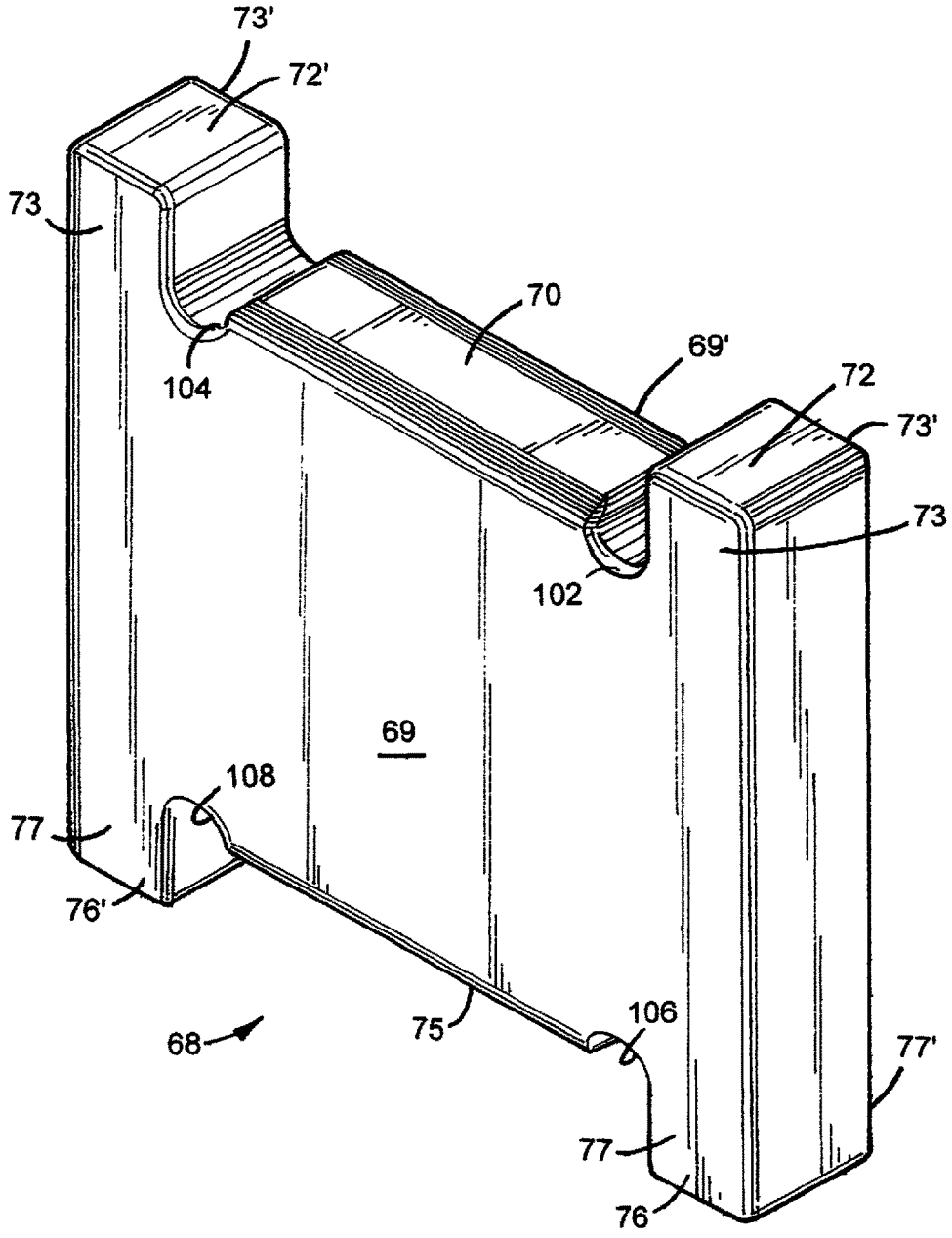
FIG. 5 is a perspective view of one element of the energy absorption/coupling system shown in FIGS. 2 and 3.
Figure 6:
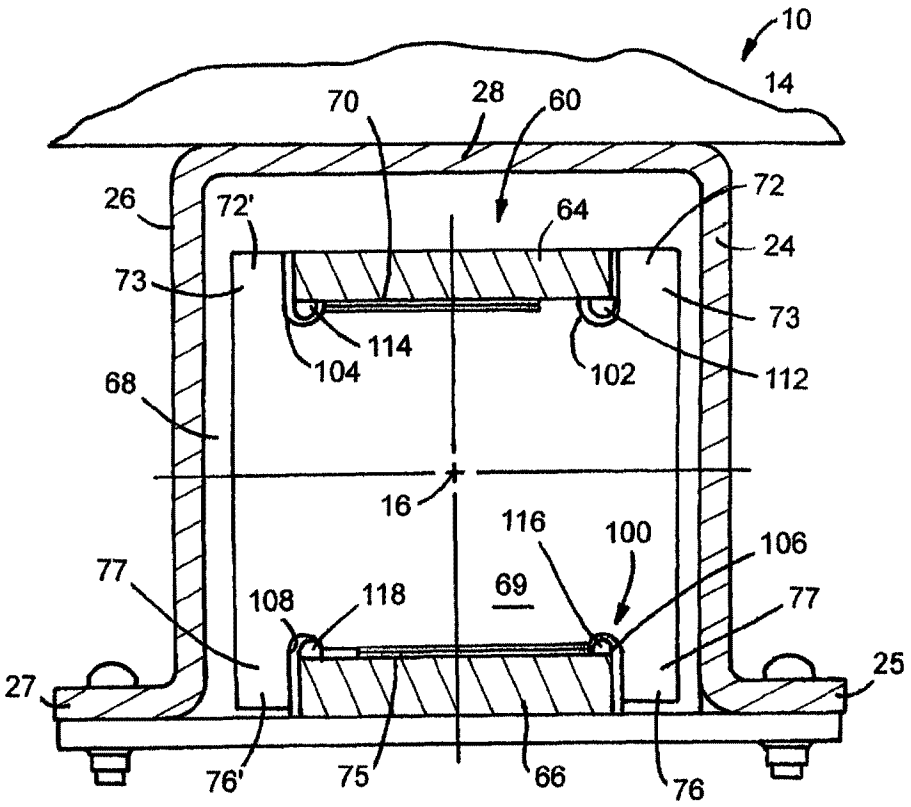
FIG. 6 is a sectional view taken along line 6-6 of FIG. 2.

To enhance the ability of the follower 68 to distribute forces across a broader area, in the embodiment illustrated in FIGS. 5 and 6, the follower 68 has a generally H-shaped configuration. A top or upper side 70 of the follower 68 is configured with two laterally spaced upstanding vertical extensions 72 and 72' disposed toward opposed upper corners of the follower 68. Preferably, a forward facing surface 73 on each extension 72 and 72' is disposed in generally planar relationship relative to each other. Moreover, in a preferred embodiment, and to add strength and rigidity thereto, the extensions 72 and 72' are formed integral with the remainder of the follower 68. In the embodiment illustrated in FIG. 5, a rearward facing surface 73' on each extension 72 and 72' is disposed in generally planar relationship relative to each other. In the illustrated embodiment, the rearward facing surface 73' on each extension 72 and 72' is also disposed in generally planar relationship relative to the major rearward surface 69' on the follower 68.

A bottom or lower side 75 of the follower 68 is configured with two laterally spaced vertical depending extensions 76 and 76' disposed toward opposed lower corners of the follower 68. The upper or top side 70 of the follower 68 is vertically separated from the bottom or lower side of the follower 68 by a distance generally equal to, or less than, the distance separating the top and bottom walls 64 and 66, respectively, of yoke 60. Preferably, a forward facing surface 77 on each extension 76 and 76' is disposed in generally planar relationship relative to each other and in generally coplanar relationship with the forward facing surface 73 on the extensions 72 and 72'. Moreover, in a preferred embodiment, and to add strength and rigidity thereto, the extensions 76 and 76' are formed integral with the remainder of the follower 68. In the embodiment illustrated in FIG. 7, a rearward facing surface 77' on each extension 76 and 76' is disposed in generally planar relationship relative to each other and in generally coplanar relationship to the rearward facing surface 73' on each extension 72 and 72' (FIG. 5).

Figure 7:
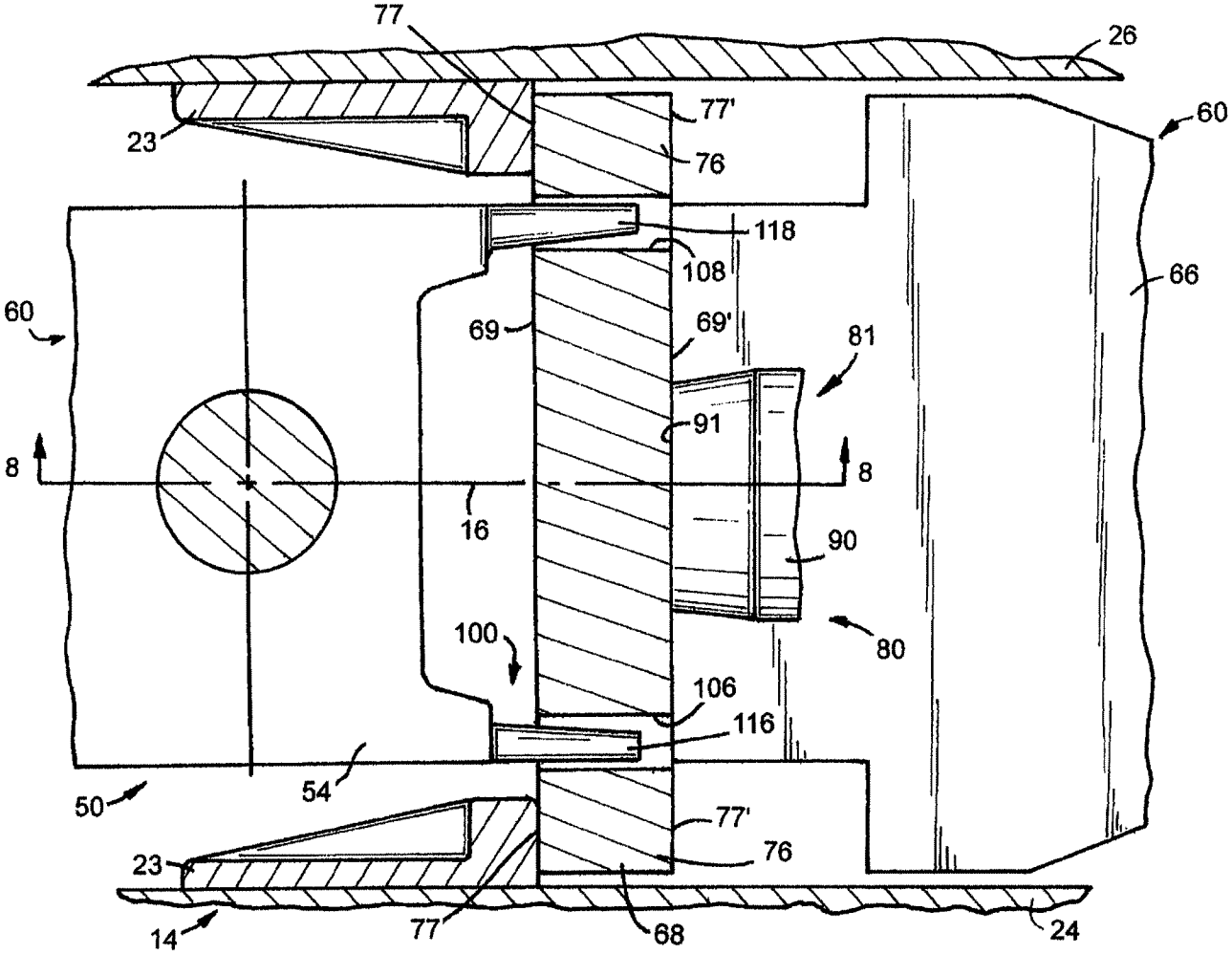
FIG. 7 is an enlarged sectional view taken along line 7-7 of FIG. 2.
Figure 8:
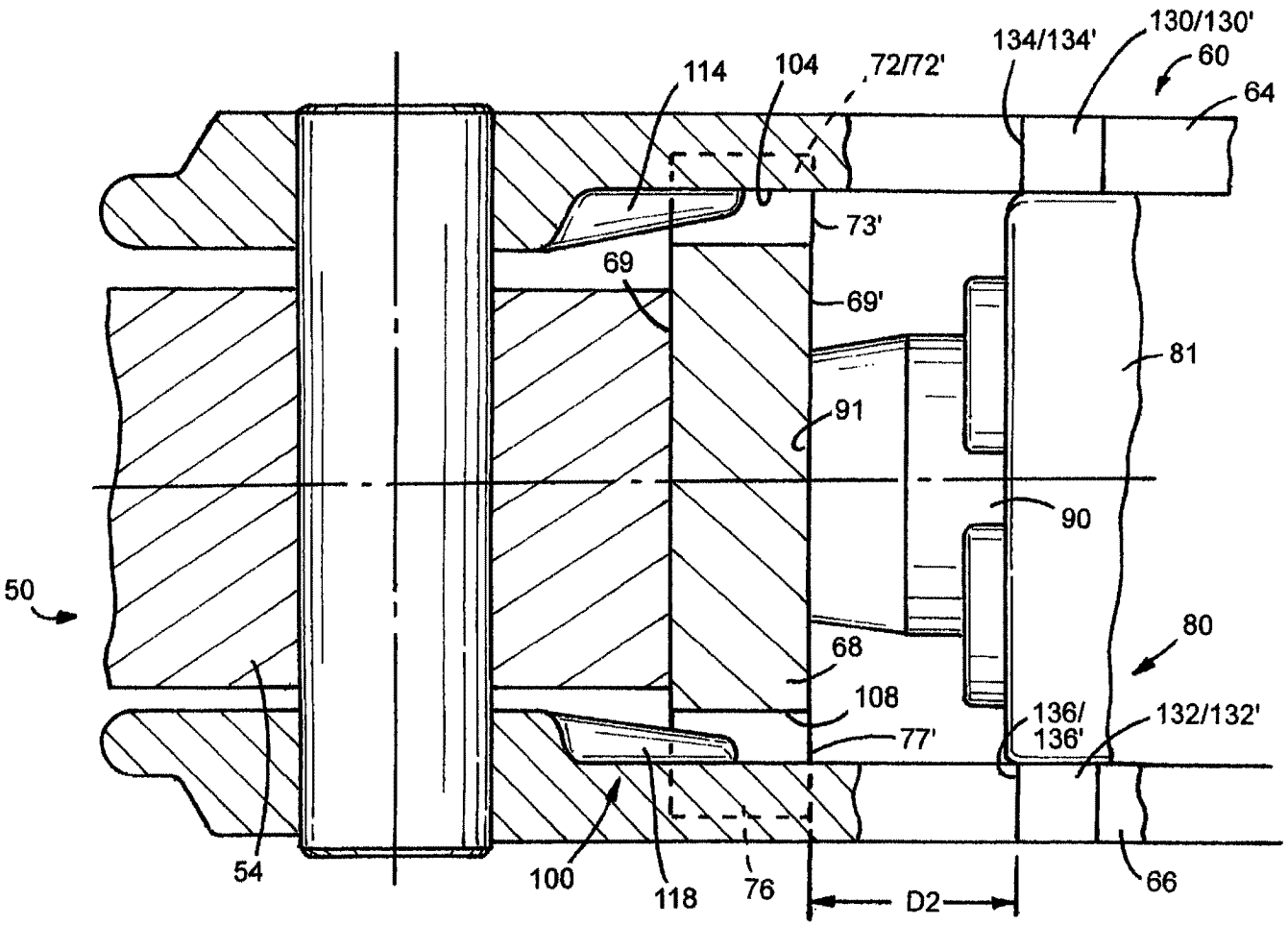
FIG. 8 is an enlarged sectional view taken along line 8 -8 of FIG. 7.

In a preferred embodiment illustrated in FIGS. 6, 7 and 8, the yoke 60 and follower 68 define cooperating instrumentalities 100 for limiting the particular type of follower that can be used in operable combination with yoke 60. In the embodiment illustrated by way of example in FIGS. 5 and 6, the follower 68 is provided with a plurality of stress relief notches or grooves 102, 104, 106 and 108. The reliefs 102, 104, 106 and 108 are preferably provided in each corner area where the extensions 72, 72' and 76, 76' project or protrude from the remainder of the follower 68. Of course, those components comprising the cooperating instrumentalities can be readily reversed from that illustrated and described without detracting or departing from the spirit and scope of this invention disclosure.

In the embodiment illustrated by way of example in FIG. 6, the cooperating instrumentalities 100 for limiting the use of a standard follower in operable combination with yoke 60 further includes a plurality of preclusion gussets 112, 114, 116 and 118 provided on the yoke 60. More specifically, and in the illustrated embodiment, preclusion gussets 112 and 114 are preferably provided on the top wall 64 of yoke 60 between the follower 68 and the open end of the yoke 60. Moreover, in the illustrated embodiment, preclusion gussets 116 and 118 arc preferably provided on the bottom wall 66 of yoke 60 between the follower 68 and the open end of the yoke 60. The preclusion gussets 112, 114, 116 and 118 are preferably arranged on the yoke 60 to operably engage with the follower 68 when the coupling assembly 80 is in a neutral position. As schematically illustrated in FIGS. 7 and 8, the preclusion gussets 112, 114, 116 and 118 on the yoke 60 cooperate with the stress relief notches or grooves 102, 104, 106 and 108, respectively, on the follower 68 so as to: a) allow the follower 68 to reach its maximum travel during its reciprocal movements during operation; and, b) inhibit use of a standard (generally rectangularly shaped) follower; and, c) permit the follower 68 to advantageously distribute draft loads over a broader area than heretofore known followers.

As illustrated in FIG. 2, when the coupling system 20 is installed in the center sill or draft sill 14 and the coupling system 20 is in a neutral or draft position, the forward facing surface 69 of the follower 68 is urged into operable engagement with the butt or free shank end 54 of the coupler 50. Moreover, when the coupling system 20 is installed in the center sill or draft sill 14 and the coupling system 20 is in a neutral or draft position, the front or forward facing surface 73 on each extension 72 and 72' of the follower 68 along with the forward facing surface 77 on each extension 76 and 76' of the follower 68 are all urged into contact with the front pair of stops 23 on the center sill 14.

With the present invention disclosure, the cushioning assembly 80 of each system 20 can be relatively easily installed in the draft gear pocket 30 using standard and well known installation procedures and in operable combination with the coupler 50. In the illustrated embodiment, and after the draft gear assembly 81 is in place in the center sill 14, standard support members 95 (FIGS. 2 and 3) can be attached to flanges 25 and 27 on the center sill walls 24 and 26, respectively, to operably support the yoke 60 and draft gear assembly 81 within draft gear pocket 30 and in operable association with the coupler 50.

Returning to FIGS. 3 and 4, in the illustrated embodiment, the top wall 64 of the yoke 60 has a two forward facing stops 130 and 130' which extend in opposed lateral directions from each other and from the axis 61 of yoke 60. In this illustrated embodiment, the bottom wall 66 of the yoke 60 also has two forward facing laterally spaced and laterally aligned stops 132 and 132' (FIG. 3) which extend in opposed lateral directions from each other and away from the axis 61 of yoke 60.

In a preferred form, the stops 130, 130' are formed integral with the top wall 64 of yoke 60 while the stops 132, 132' are formed integral with the bottom wall 66 of yoke 60. The stops 130, 130', 132 and 132' are arranged relative to each other to provide the yoke 60 with four co-planar forward-facing stopping surfaces 134, 134' and 136, 136'. In the embodiment illustrated by way of example, the stopping surfaces 134, 134' and 136, 136' all extend generally perpendicular to the longitudinal axis 61 of the yoke 60. As shown in the embodiment illustrated by way of example in FIG. 3, the two stops 130, 130' on the yoke 60 are preferably disposed above the longitudinal axis 16 and preferably in generally coplanar relationship with the top wall 64 of yoke 60. Also, the two stops 132, 132' on the yoke 60 are preferably disposed below the longitudinal axis 16 and preferably in generally coplanar relationship with the bottom wall 66 of the yoke 60. Moreover, two stopping surfaces 134 and 136 on the yoke 60 are preferably disposed to one lateral side of the longitudinal axis 16 while two additional stopping surfaces 134' and 136' are disposed to an opposed lateral side of the axis 16.

As shown by way of example in FIG. 8, when each cushioning assembly 20 is in a neutral position or condition, the co-planar forward-facing stop surfaces 134, 134' and 136, 136' on the stops 130, 130' and 132, 132' on the yoke 60 (FIG. 3) are disposed a predetermined distance D2 (FIG. 9) from the confronting rearward facing surfaces 73' and 77' on the extensions 72, 72' and 76, 76' of follower 68.

Figure 9:
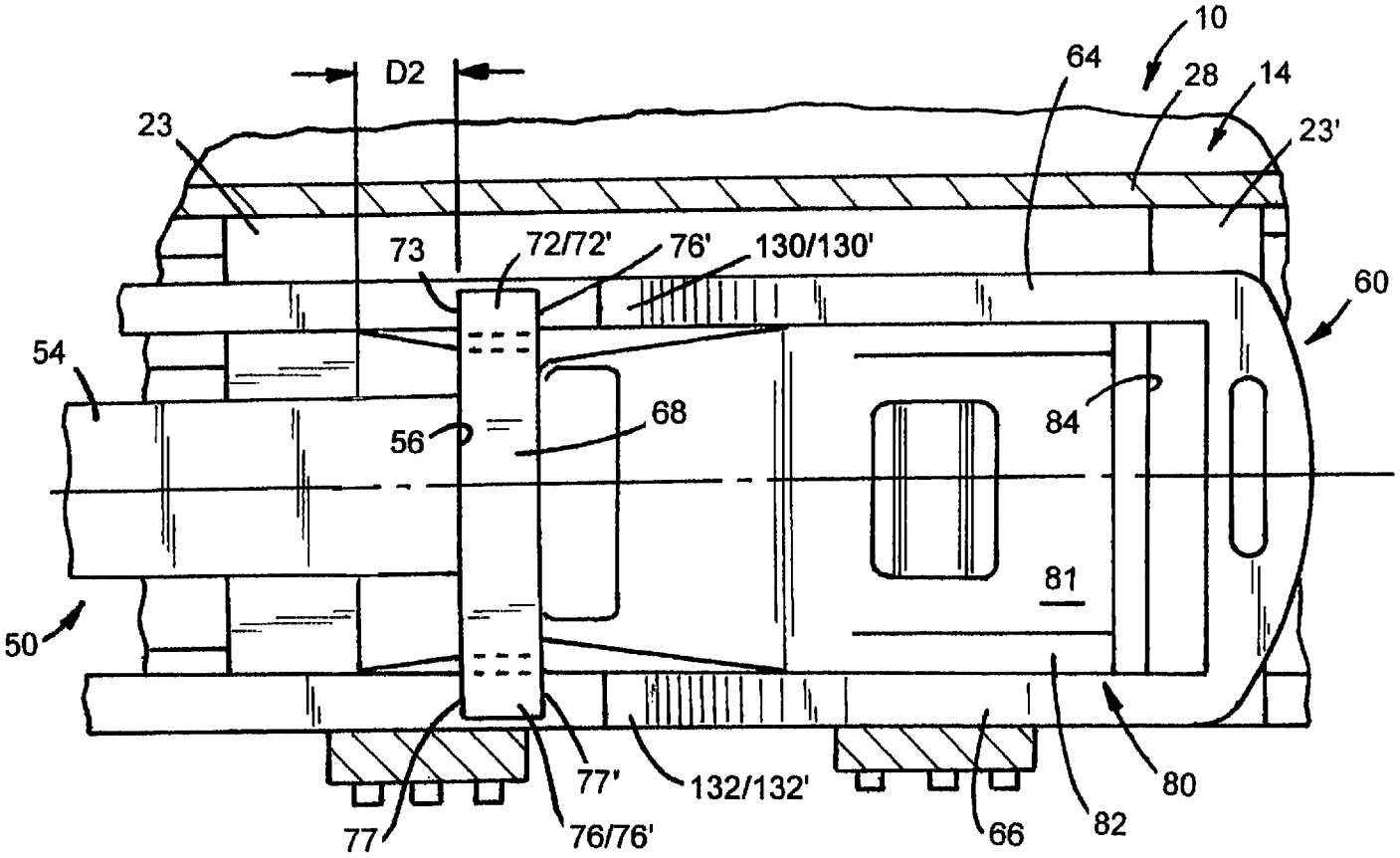
FIG. 9 is an enlarged view similar to FIG. 2 showing the energy absorption/coupling system in a full buff position.
Figure 10:
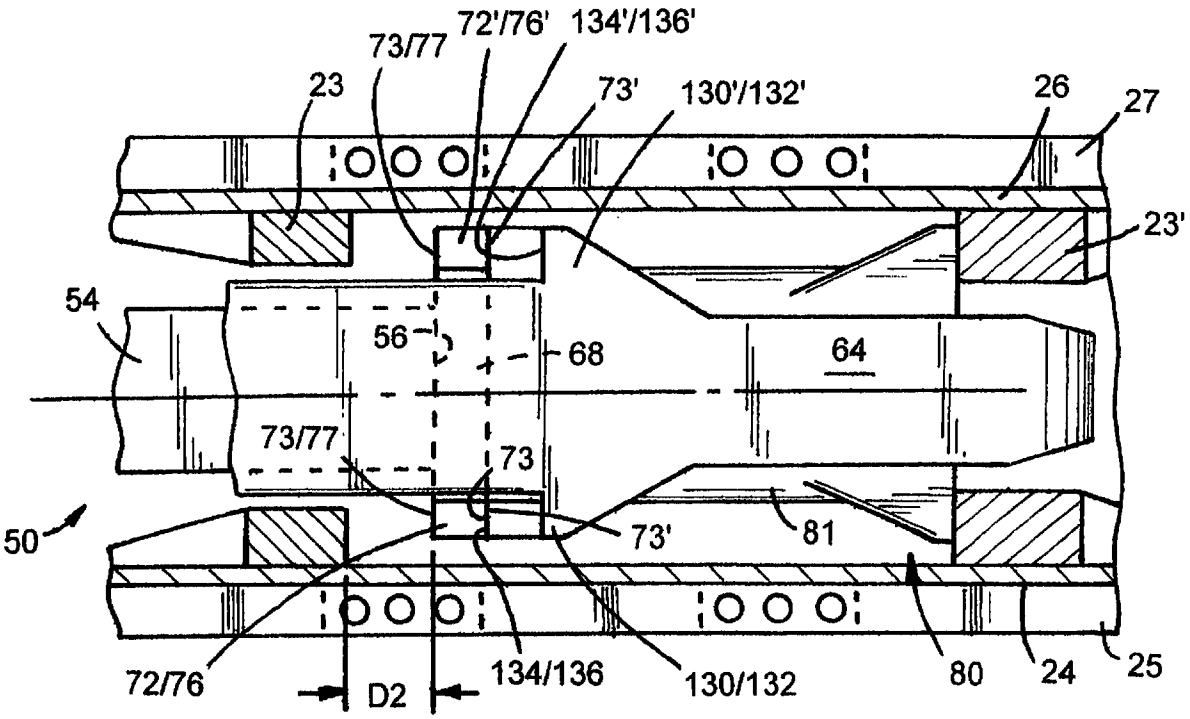
FIG. 10 is an enlarged view similar to FIG. 4 showing the energy absorption/coupling system in a full buff position.

FIGS. 9 and 10 illustrate the coupling system 20 in a full buff position. In the embodiment shown by way of example in FIGS. 9 and 10, the rear stops 23' on the center sill 14 allow the coupling system 20 to be disposed about 3.25 inches from the neutral position when in a full buff position, with the rear end 84 of the draft gear housing 82 being positioned against the stops 23' on the draft gear sill 14. In the illustrated full buff position of the coupling system 20, the co-planar forward-facing stopping surfaces 73 and 77 on each extension 72, 72' and 76, 76', respectively, of the follower 68 extend at least the predetermined distance D2 from the front stop members 23 on the center sill 14. Preferably, the predetermined distance D2 generally equals the distance D1 the free end 91 of the wedge member 90 typically extends past the open end 86 of the housing 82 when the yoke 60 is in a neutral position.

Figure 11:
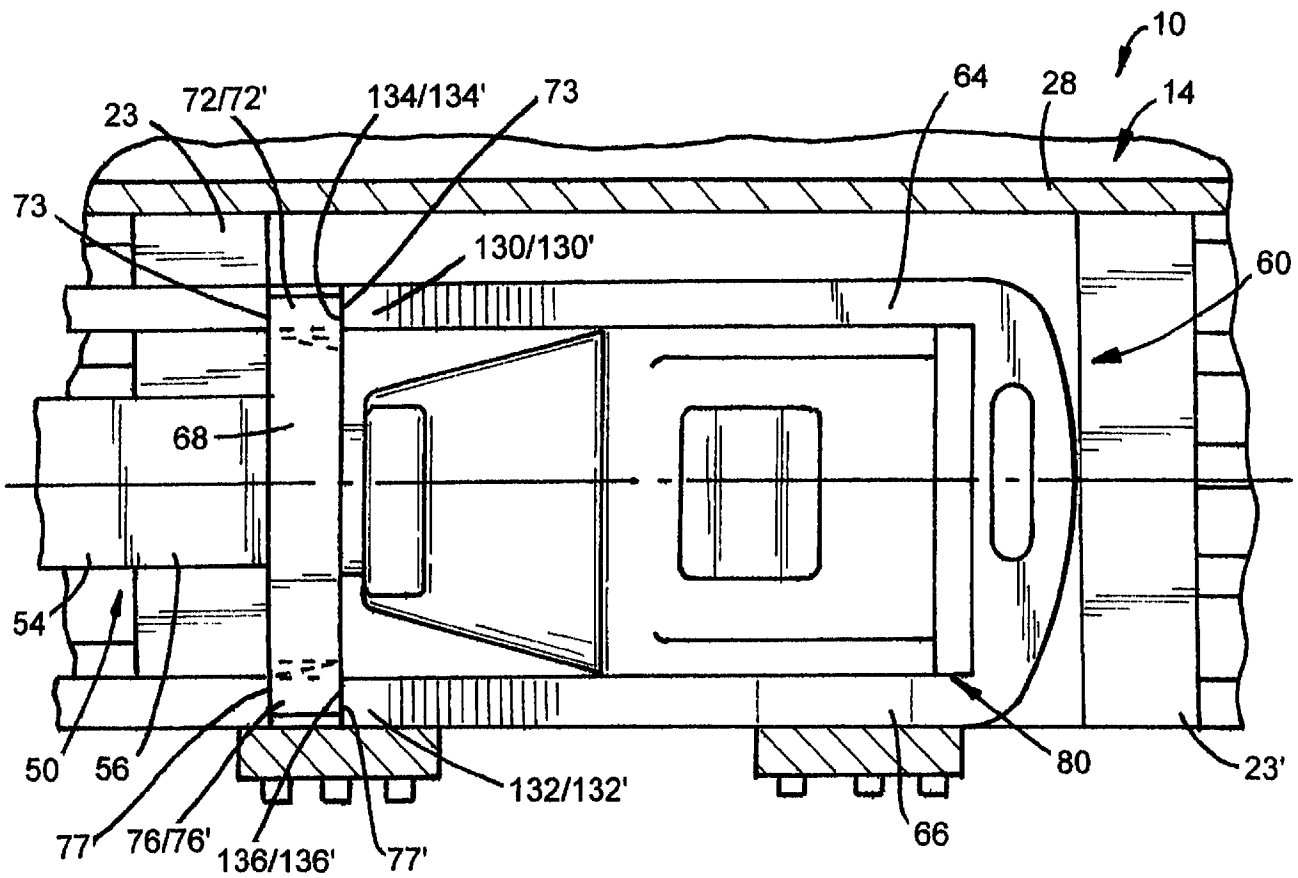
FIG. 11 is an enlarged view similar to FIG. 9 but showing the energy absorption/coupling system in a full draft position.
Figure 12:
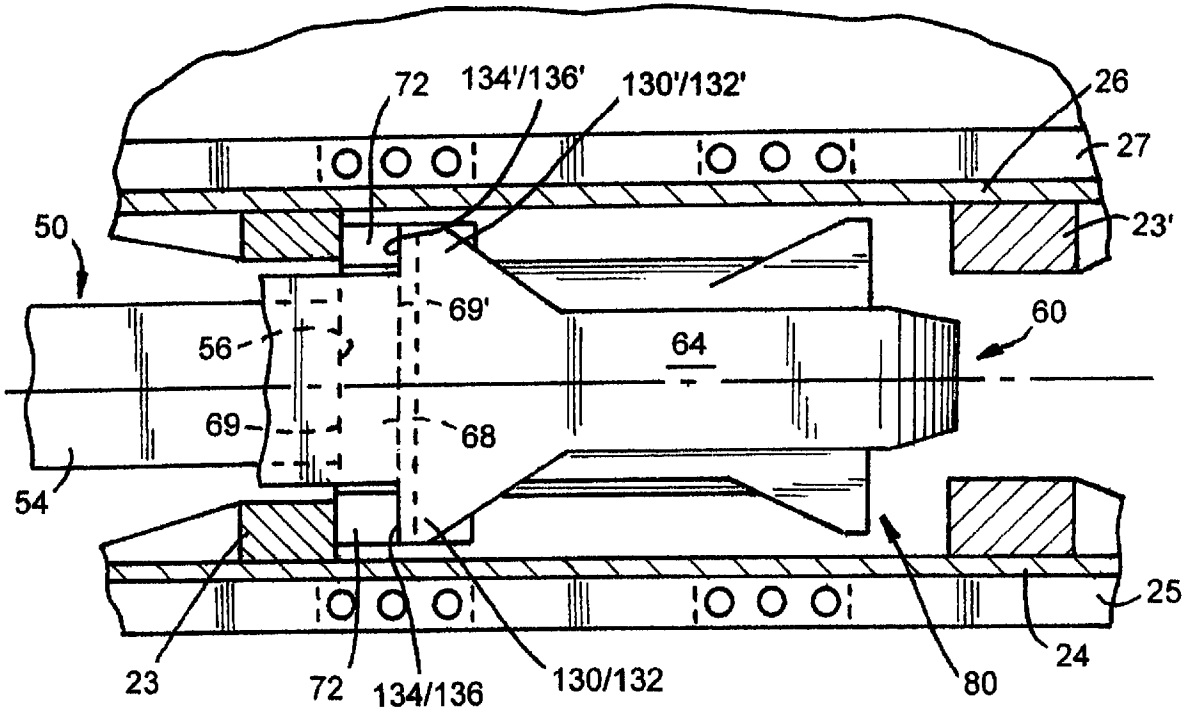
FIG. 12 is an enlarged view similar to FIG. 10 but showing the energy absorption/coupling system in a full draft position.

FIGS. 11 and 12 illustrate the coupling system 20 in a full draft position or condition. In the full draft position or condition, and in the embodiment illustrated by way of example in FIGS. 11 and 12, yoke 60 is drawn to the left under the influence of the coupler 50. As the yoke 60 is drawn to the left under the influence of the coupler 50, the cushioning assembly 80 axially compresses. In the illustrated embodiment of the cushioning assembly 80, the spring assembly 94 (FIG. 2) of the draft gear assembly 81 is compressed by the wedge member 90 axially retracting within the housing 82 as the free end 91 of the wedge member 90 presses against the coupler follower 68 which is halted from further movement to the left by the front stops 23.

During draft travel of the coupling system 20, and in the embodiment illustrated in FIG. 2, the distance D1 (FIG. 2) is collapsed by movement of the yoke 60 to the left as shown in FIGS. 11 and 12. During draft movements of the coupling system 20, the multiple co-planar forward-facing stopping surfaces 134, 134' and 136, 136' on the yoke stops 130, 130' and 132, 132', respectively, positively contact and engage with the confronting and rearward facing surface 73' and 77' on each extension 72, 72' and 76, 76', respectively, on the follower 68. Draft movements of the cushioning assembly 20 will continue until the forward facing surface 73 and 77 on each extension 72, 72' and 76, 76' and, preferably, the front facing surface area on the follower 68 spanning the distance between the extensions 72, 76 and 72', 76', engages with the pair of front stops 23 on the draft gear sill 14 whereby halting further movement of the yoke 60 in the draft direction. As will be readily appreciated, the extensions extension 72, 72', 76, 76' on the generally H-shaped follower 68 enhance the engagement area between both the yoke 60 and the follower 68 as well as the front stops 23 and the follower 68 whereby advantageously distributing the relatively large forces over a broader area and thereby enhancing overall performance characteristics of the cushioning assembly.

Preferably, and in the illustrated embodiment, when the cushioning assembly 20 is in a neutral condition or position, the predetermined distance D2 (FIG. 2) the co-planar forward-facing stop surfaces 134, 134' and 136, 136' on the yoke 60 is disposed from the rearward facing confronting surfaces 73' and 77' on each follower extension 72, 72' and 76, 76' when the forward facing surface 73 and 77 on each follower extension 72, 72' and 76, 76' operably engage with the pair of forward stops 23 on the draft sill 14 is about equal to or less than the predetermined distance D1 the free end of wedge member 90 axially extends beyond the open end 86 of the draft gear housing 82. Of course, and as should be appreciated, the draft travel of the system 20 can easily be modified or changed simply by modifying or otherwise changing the predetermined distance D2 the co-planar forward-facing stop surfaces 134, 134' and 136, 136' on the yoke 60 is disposed from the rearward facing confronting surfaces 73' and 76' on each follower extension 72, 72' and 76, 76' when the forward facing surface 73 and 77 on each follower extension 72, 72' 76, 76'operably engage with the forward pair of stops 23. That is, and as will be appreciated from the foregoing, the location of the stops 130, 130', 132 and 132' on the yoke 60 can: 1) limit draft travel; 2) maximize buff travel; and, 3) limit total combined travel of the coupling system 20 while furthermore advantageously preventing inadvertent separation of the railcars and unwarranted braking and/or separation of the air hoses 17 (FIG. 1); and, limit compression of the coupling system 20 so as to offer protection to the spring assembly 94 (FIG. 2) associated with each energy absorption apparatus 80 of the coupling system.

In one embodiment, the coupling system 20 preferably will have a combined travel in both buff and draft directions of about 6.5 inches. It should be readily appreciated from the above disclosure, however, the travel of the yoke 60 during the draft operation of the coupling system 20 can be modified to change the combined travel in both buff and draft directions simply by relocating the multiple co-planar forward-facing stopping surfaces 134, 134', 136 and 136' defined by the stops 130, 130', 132, and 132' from that disclosed without detracting or departing from the true spirit and novel concept of this invention disclosure. As such, the yoke 60 and, more particularly, locations of the stops can be configured to allow greater buff travel than draft travel, if so desired.

From the forgoing, it will be observed numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated and discussed. Rather, this disclosure is intended to cover by the appended claims all such modifications and variations as fall within the spirit and scope of the claims.

What is claimed is:

1. A railroad car coupling system extending longitudinally into a car center sill structure for releasably connecting adjacent railcar ends, said center sill structure defining a cavity and a longitudinal axis along with a longitudinally spaced pair of front and rear stops, said coupling system comprising:

a yoke retained within the cavity defined by said center sill structure and having a longitudinal axis, with said yoke including a top wall disposed to one vertical side of the longitudinal axis of said yoke and a bottom wall disposed to an opposite vertical side of the longitudinal axis of said yoke, with said walls extending longitudinally and generally parallel to each other, with said top and bottom wall being joined to define a yoke pocket, and with said yoke defining two forward facing stops located on the top wall of said yoke and extending in opposed lateral directions relative to the longitudinal axis of said yoke, and with said yoke further defining another two forward facing stops located on a bottom wall of said yoke and extending in opposed lateral directions relative to the longitudinal axis of said yoke, with forward facing stopping surfaces defined by said stops on the top and bottom walls of said yoke being arranged in generally coplanar relationship relative to each other;

a coupler having a coupler head disposed toward a first end and outward from an end of said center sill and a butt end extending from said coupler head and longitudinally into said yoke pocket, with said coupler being operably coupled to said yoke;

a cushioning assembly for receiving and dissipating external forces experienced by said coupler, with said forces being transferred from said coupler head to the butt end of said coupler;

a follower mounted substantially between said top and bottom walls of said yoke for receiving forces experienced by said coupler, with said follower being positioned transversely relative to the longitudinal axis of said yoke and including a front face and a rear face, with said follower being arranged and urged toward an open end of said yoke by said cushioning assembly such that the front face of said follower is urged into contact with the butt end of said coupler, and with a top side of said follower being configured with two laterally spaced vertical extensions disposed toward opposed upper corners of said follower, and a bottom side of said follower being configured with two laterally spaced vertical extensions disposed toward opposed lower corners of said follower, with forward facing surfaces on the extensions front face being arranged in generally coplanar relationship relative to each other, and with rearward facing surfaces on the extensions rear face being arranged in generally coplanar relationship relative to each other, and with the rearward facing surfaces on said follower's extensions being in operable engagement with the forward facing stopping surfaces on the yoke to enhance the distribution of forces when the forward facing surfaces on the extensions of said follower engage the front stops on the center sill when the coupling system is in a full draft condition.

2. The railroad car coupling system according to claim 1, wherein draft travel of said coupling system is independently controlled relative to buff travel of said coupling system and is regulated as a function of the location of the four forward facing stops on said yoke.

3. The railroad car coupling system according to claim 1, wherein said railroad car coupling system will have a total combined travel in both draft and buff directions of about 6.5 inches.

4. The railroad car coupling system according to claim 1, wherein the stops on said yoke prevent potential separation of said coupler from said center sill structure.

5. The railroad car coupling system according to claim 1, wherein the stops on said yoke are formed integral with the top and bottom walls of said yoke.

6. The railroad car coupling system according to claim 1, wherein the two stops on the top wall of said yoke are arranged in generally coplanar relation with the top wall of said yoke and said another two stops on the bottom wall of said yoke are arranged in generally coplanar relation with the bottom wall of said yoke.

7. The railroad car coupling system according to claim 1, wherein said cushioning assembly includes at least one draft gear assembly having a walled housing.

8. The railroad car coupling system according to claim 1, wherein said yoke is slidably movable relative to the walled housing of said draft gear assembly.

9. A railroad car coupling system extending longitudinally into a car center sill structure for releasably connecting adjacent railcar ends, said center sill structure defining a cavity, a longitudinal axis, along with longitudinally spaced pairs of front and rear stops, said coupling system comprising:

a yoke movably retained within the cavity defined by said center sill structure, with said yoke having a longitudinal axis arranged in general alignment with the center sill longitudinal axis and including a top wall and a bottom wall which extend longitudinally and generally parallel to each other, with said top and bottom wall being connected to a rear wall so as to define a yoke pocket, and with the top wall of said yoke defining a two forward facing stops which are arranged in generally coplanar relationship relative to each other and extend in opposed lateral directions relative to the longitudinal axis of said yoke, and with the bottom wall of said yoke defining two forward facing stops which are arranged in generally coplanar relationship relative to each other and extend in opposed lateral directions relative to the longitudinal axis of said yoke, with forward facing stopping surfaces defined by the stops on the top and bottom walls of said yoke being arranged in generally coplanar relationship relative to each other;

a coupler having a coupler head disposed toward a first end and outward from an end of said center sill and a butt end extending from said coupler head and longitudinally into said yoke pocket, with said coupler being operably coupled to said yoke;

a cushioning assembly arranged in said yoke pocket for receiving and dissipating external forces experienced by said coupler, with said forces being transferred from said coupler head to the butt end of said coupler;

a follower mounted substantially between said top and bottom walls of said yoke for receiving forces experienced by said coupler, with said follower being positioned transversely relative to the longitudinal axis of said yoke and is configured with a front face and a rear face, with the said follower being urged toward an open end of said yoke by said cushioning assembly such that the front face of said follower is urged into contact with the butt end of said coupler, and with the front face of said follower contacting the front pair of stops on said center sill when said coupling system is in a neutral or full draft condition, and with said follower and said yoke defining cooperating instrumentalities for restricting use of a standard follower between said top and bottom walls of said yoke.

10. The railroad car coupling system according to claim 9, wherein the cooperating instrumentalities for restricting use of a standard follower between said top and bottom walls of said yoke includes preclusion gussets on one of said yoke and said follower and relief notches defined by the other of said yoke and said follower.

11. The railroad car coupling system according to claim 9, wherein the cooperating instrumentalities for restricting the use of a standard follower between said top and bottom walls of said yoke includes preclusion gussets on said yoke and relief notches defined by said follower, with said preclusion gussets being arranged on said yoke to operably engage with said follower when said coupling system is in a neutral condition.

12. The railroad car coupling system according to claim 9, wherein the draft travel of said coupling system is independently controlled relative to buff travel of said coupling system and is regulated as a function of the location of the four forward facing stops on said yoke.

13. The railroad car coupling system according to claim 9, wherein said railroad car coupling system will have a total combined travel in both draft and buff directions of about 6.5 inches.

14. The railroad car coupling system according to claim 9, wherein the stops on said yoke inhibit potential separation of said coupler from said center sill structure.

15. The railroad car coupling system according to claim 9, wherein the stops on said yoke are formed integral with the top and bottom walls of said yoke.

16. The railroad car coupling system according to claim 9, wherein the two stops on the top wall of said yoke are arranged in generally coplanar relation with the top wall of said yoke and the two stops on the bottom wall of said yoke are arranged in generally coplanar relation with the bottom wall of said yoke.

17. The railroad car coupling system according to claim 9, wherein said cushioning assembly includes a draft gear assembly with a walled housing.

18. The railroad car coupling system according to claim 17, wherein said yoke is slidably movable relative to the walled housing of said draft gear assembly.

19. A railroad car coupling system extending longitudinally into a car center sill structure for releasably connecting adjacent railcar ends, said center sill structure defining a cavity, a longitudinal axis, along with longitudinally spaced pairs of front and rear stops, said coupling system comprising:

a yoke retained within the cavity defined by said center sill structure, with said yoke having a longitudinal axis arranged in general alignment with the center sill longitudinal axis and including a top wall and a bottom wall which extend longitudinally and generally parallel to each other, with said top and bottom all being connected to a rear wall so as to define a yoke pocket, and with the top wall of said yoke defining two forward facing stops which extend in opposed lateral directions relative to the longitudinal axis of said yoke, and with the bottom wall of said yoke defining two forward facing stops which extend in opposed lateral directions relative to the longitudinal axis of said yoke, with forward facing stopping surfaces defined by said stops on the top and bottom walls of said yoke being arranged in generally coplanar relationship relative to each other;

a coupler having a coupler head disposed toward a first end and outward from an end of said center sill and a butt end extending from said coupler head and longitudinally into said yoke pocket, with said coupler being operably coupled to said yoke;

a cushioning assembly arranged in said yoke pocket for receiving and dissipating external forces experienced by said coupler, with said forces being transferred from said coupler head to the butt end of said coupler;

a follower mounted substantially between said top and bottom walls of said yoke for receiving forces experienced by said coupler, with said follower being positioned transversely relative to the longitudinal axis of said yoke and has a generally rectangular configuration including a major front face and a major rear face, with the said follower being urged toward an open end of said yoke by said cushioning assembly such that the major front face of said follower is urged into contact with the butt end of said coupler, and with a top side of said follower being configured with two laterally spaced vertical extensions disposed toward opposed upper corners of said follower, and a bottom side of said follower being configured with two laterally spaced vertical extensions disposed toward opposed lower corners of said follower, with forward facing surfaces on the extensions on said follower being arranged in generally coplanar relationship relative to each other, and with rearward facing surfaces on the extensions on said follower being arranged in generally coplanar relationship relative to each other, with the rearward facing surfaces on the extensions being in operable contact with the forward pairs of stops on said center sill when said coupling system is in a neutral or full draft position, and with rearward facing surfaces on the extensions being in operable engagement with the forward facing stops on the yoke so as to enhance the distribution of force when the system is in full draft position, and wherein said follower and said yoke define cooperating instrumentalities for restricting use of a standard follower between said top and bottom walls of said yoke.

20. The railroad car coupling system according to claim 19, wherein draft travel of said coupling system is independently controlled relative to buff travel of said coupling system and is regulated as a function of the location of the four forward facing stops on said yoke.

21. The railroad car coupling system according to claim 19, wherein said railroad car coupling system will have a total combined travel in both draft and buff directions of about 6.5 inches.

22. The railroad car coupling system according to claim 19, wherein the stops on said yoke inhibit potential separation of said coupler member from said center sill structure.

23. The railroad car coupling system according to claim 19, wherein the stops on said yoke are formed integral with the top and bottom walls of said yoke.

24. The railroad car coupling system according to claim 19, wherein the two stops on the top wall of said yoke are arranged in generally coplanar relation with the top wall of said yoke and the two stops on the bottom wall of said yoke are arranged in generally coplanar relation with the bottom wall of said yoke.

25. The railroad car coupling system according to claim 19, wherein said cushioning assembly includes at least one draft gear assembly with a walled housing.

26. The railroad car coupling system according to claim 25, wherein said yoke is slidably movable relative to the walled housing of said draft gear assembly.

27. The railroad car coupling system according to claim 19, wherein the cooperating instrumentalities for restricting the type of follower which can be mounted substantially between said top and bottom walls of said yoke includes preclusion gussets on one of said yoke and said follower and relief notches defined by the other of said yoke and said follower.

28. The railroad car coupling system according to claim 19, wherein the cooperating instrumentalities for restricting the use of a standard follower between said top and bottom walls of said yoke includes preclusion gussets on said yoke and relief notches defined by said follower, with said preclusion gussets being arranged on said yoke to operably engage with said follower when said coupling system is in a neutral condition.

* * * * *